US005868653A

United States Patent [19]

Klasen

[11] Patent Number: 5,868,653

[45] Date of Patent: Feb. 9, 1999

[54] VIBRATING BARBELL

[76] Inventor: Heinz Klasen, Von-Luck-Strasse 56, D-14129 Berlin, Germany

[21] Appl. No.: 951,240

[22] Filed: Oct. 16, 1997

Related U.S. Application Data

[63] Continuation-in-part of Ser. No. 707,137, Sep. 3, 1996, abandoned.

[30] Foreign Application Priority Data

Sep. 1, 1995 [DE] Germany ..... 195 32 254.1

[51] Int. Cl.[6] ..... A63B 21/22

[52] U.S. Cl. ..... 482/110; 482/108; 601/72

[58] Field of Search ..... 482/106, 108, 482/107, 110; 601/67, 70, 72, 73, 80, 82, 85, 87, 89, 93, 97, 101

[56] References Cited

U.S. PATENT DOCUMENTS

| | | | |
|---|---|---|---|
| 850,938 | 4/1907 | Kellogg | 482/108 |
| 1,013,782 | 1/1912 | Koch | 482/108 |
| 1,828,895 | 10/1931 | Hanley | 601/101 X |
| 2,447,218 | 8/1948 | Trzesniewski | 482/106 |
| 3,363,623 | 1/1968 | Atwell | 601/72 |
| 3,617,056 | 11/1971 | Herbold . | |
| 4,025,809 | 5/1977 | Teranishi | 601/73 X |
| 4,059,100 | 11/1977 | Glage | 601/101 X |
| 4,326,314 | 4/1982 | Moret | 601/93 X |
| 4,878,489 | 11/1989 | Kamayachi | 601/72 |
| 5,078,392 | 1/1992 | Kracht | 482/107 |
| 5,250,014 | 10/1993 | Chang | 482/108 X |
| 5,393,284 | 2/1995 | Wesley | 482/106 |

FOREIGN PATENT DOCUMENTS

| | | | |
|---|---|---|---|
| 3609363 | 11/1987 | Germany . | |
| 1623671 | 1/1991 | U.S.S.R. | 482/108 |
| 1694162 | 11/1991 | U.S.S.R. | 482/106 |

OTHER PUBLICATIONS

Popular Mechanics, Feb. 1962, p. 136.

*Primary Examiner*—Richard J. Apley
*Assistant Examiner*—William LaMarca
*Attorney, Agent, or Firm*—Cohen, Pontani, Lieberman & Pavane

[57] ABSTRACT

A barbell includes a substantially tubular-shaped barbell bar enclosing a device for causing the barbell bar to vibrate, weights attached to each end of the barbell bar and a damping material interposed between the barbell bar and the weights. The damping material prevents the weights from being subject to the vibrations. As a result, vibrations are transmitted to the muscles used for lowering and raising the barbell bar thereby reducing the time expended to train and the tendency to develop a cramp. Furthermore, because the weights are disconnected from the vibrations, the stability of the barbell weight and training arm is not disturbed and the energy consumption of the motor remains low.

8 Claims, 2 Drawing Sheets

VIBRATING BARBELL

This is a continuation-in-part, of application Ser. No. 08/707,137, filed Sep. 3, 1996, now abandoned.

BACKGROUND OF THE INVENTION

1. Field of the Invention

The present invention relates to a weight training barbell, more particularly to a barbell which vibrates thereby reducing the time needed to train and the tendency to develop a cramp with little stress to the body.

2. Description of the Related Art

Conventional barbells comprising a tube-shaped barbell bar and weights placed on its ends are well known and widely used. Barbells of the aforementioned type serve to train the muscles, especially the musculus biceps brachii (bicipital arm muscle) and the musculus triceps brachii (tricipital arm muscle). Training sequences with conventional barbells place high requirements on the endurance of the person doing the training, because measurable success is achieved only after a relatively long period of training. Furthermore, during the exercises, problems caused by the rough and fine coordination of the movement sequences can develop over time.

A barbell with a tube-shaped bar that carries weights at its ends is described in German patent publication DE 36 09 363 C2. At each end the weights are located within enlarged hollow tips. The hollow space is larger than the weight located therein. As a result, when the direction of movement of the barbell is reversed, the deceleration of the inert masses does not occur until after the weight has moved through the empty space and arrived at the limiting wall of the space that faces away from the direction of movement. Consequently, the muscles and wrist of the person training experience an unexpected impetus at this time, caused by the deceleration of the inert masses, thereby placing great stress on the muscles and wrist.

Another barbell with a tube-shaped bar with disc-shaped weights attached to its ends is described in U.S. Pat. No. 3,617,056. The weights are located on a shaft that runs through the bar of the barbell and is mounted therein so that the weights can rotate. The weights connected to one another in this way can be placed into rapid rotation. When the weights are placed in rapid rotation, the barbell opposes the rotation of the rotational axis with high resistance. However, a sudden change in the direction of movement can result in nutational or precessional motions.

It is desirable to develop a muscle training device which is capable of efficiently achieving muscle development without causing undue stress to the body of the person training.

SUMMARY OF THE INVENTION

An object of the present invention is to provide a muscle-training device that assist in achieving accelerated muscular formation of the musculus biceps and the musculus triceps with simultaneous development of muscular and movement coordination without causing undue stress on the body of the person training.

In accordance with the invention, the barbell includes a substantially tubular-shaped barbell bar enclosing a means for causing the barbell bar to vibrate, weights attached to each end of the barbell bar and a damping material interposed between the barbell bar and weights. The damping material prevents the weights from being subject to the vibrations while at the same time permitting the vibrations of the barbell bar to be transmitted to the muscle parts used in lifting and lowering the barbell weight. In addition, the vibrations stimulate the nerves that coordinate the sequence of movements. As a result, a clearly more marked hypertrophy of the muscles used is noted than during training with conventional barbells and the tendency to develop a cramp, which is otherwise often observed, declines.

Furthermore, because the weights are disconnected from the vibrations, the stability of the barbell weight and training arm is not disturbed and the energy consumption of the motor remains low. Comparisons between conventional training methods and exercises with the vibrating barbell according to the invention have shown that the successes of conventional training can be achieved with a time expenditure up to approximately 80% lower.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PRESENTLY PREFERRED EMBODIMENTS

Figure 1:
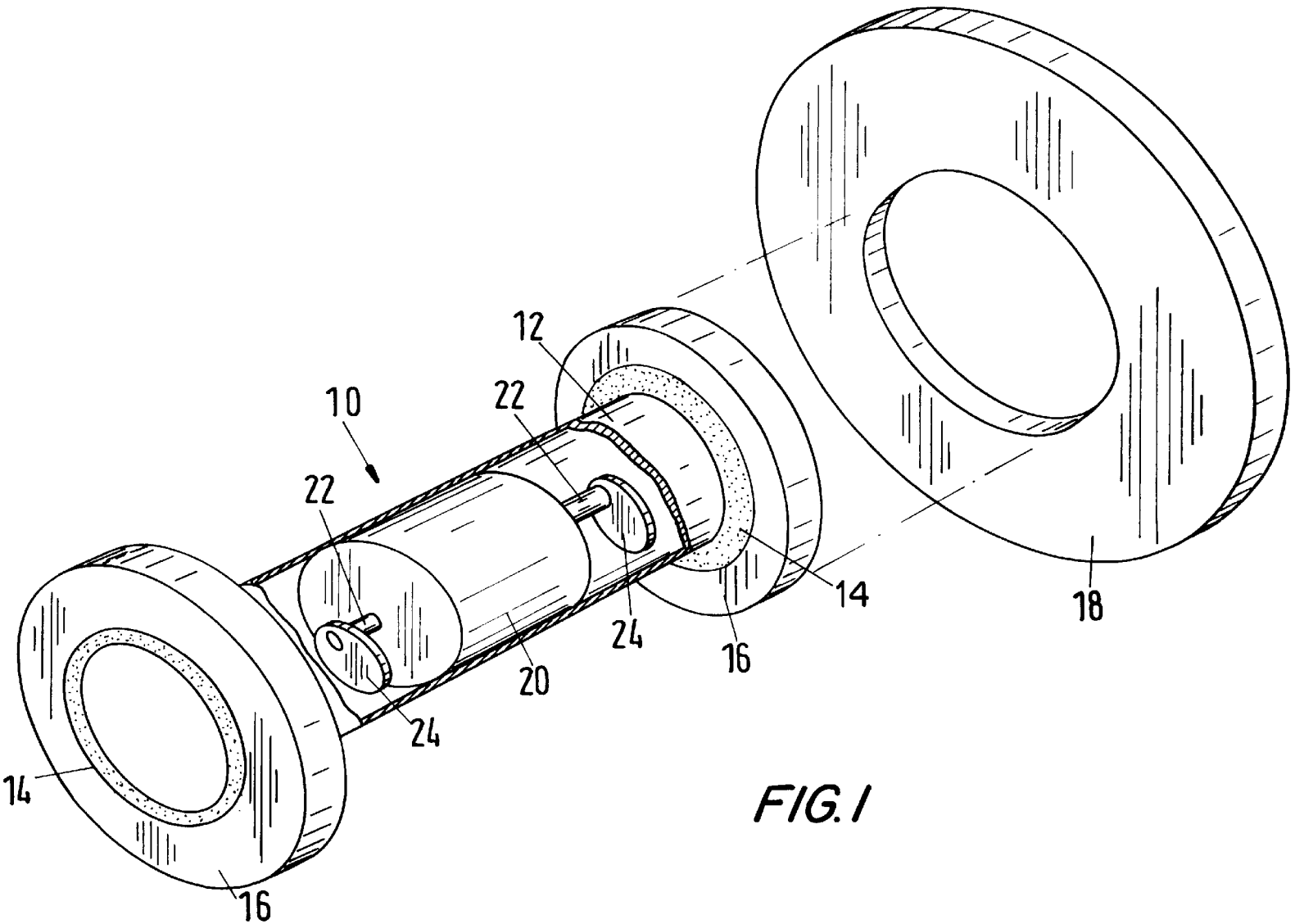
FIG. 1 is a perspective with a partial sectional view of a barbell in accordance with the present invention and FIG. 2 is an end view of another embodiment of the inventive barbell.
Figure 2:
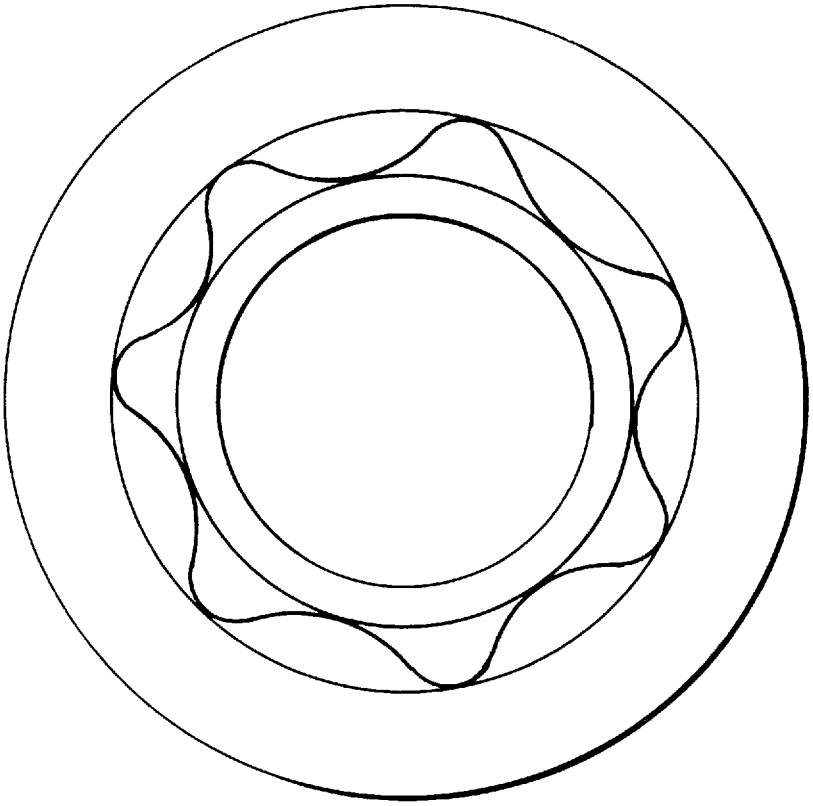

The figure shows a perspective with a partial sectional view of a barbell 10 in accordance with the present invention. Barbell 10 includes a substantially tubular-shaped barbell bar 12, on each of the two ends of which there is attached, with the intermediate placement of a first ring 14 of a cushioning material, for example, foamed plastic, a second ring 16 of a substantially rigid material such as metal i.e., steel. The second rings 16 constitute the basic weight of the barbell 10 and are fixed to the barbell bar 12. Generally disc-shaped additional weights 18 can be attached concentrically around the second rings 16, as known from conventional barbells.

As shown by the partial sectional view, a motor 20 is mounted in a region of center of gravity within the barbell bar 12 in a turn-proof manner, e.g. the walls of the motor are affixed to the inside walls of the barbell bar 12. Shaft ends 22 extend out from each end of the motor 20. An unbalanced mass 24 is connected to each shaft end 22. Instead of, or in addition to, the unbalanced masses 24, a rotor of the motor 20 can also be unbalanced. All of the unbalanced masses are equal in weight and in phase with one another. Moreover, the unbalanced masses are symmetric to the center of gravity of the barbell. Due to this, the occurrence of rotating free mass moments, which over time would be perceived as unpleasant or uncomfortable at the users' wrist, is avoided. The motor 20 and the unbalanced masses 24 are configured so that the bar 12 has a vibration amplitude of 1.2 to 0.6 mm at a frequency of 25 to 60 Hz.

The motor 20 can be supplied with power from the outside, for example, from the electrical network of the building, via a power supply cable (not shown). In additional embodiments, the barbell bar 12 can be placed into vibration by means other than an electric motor such as electromagnetic and piezoelectric vibrators.

During operation of the barbell, when a training person lifts the barbell 10 with the motor 20 running, the musculus biceps and the musculus triceps are tensed. The vibrations caused by the rotating unbalanced masses 24 are transmitted to the muscles. However, the rings 14 of the cushioning material separate these vibrations from the weights 16 and additional weights 18. The cushioning material of the rings 14 has a spring rate, for example 50 N/mm, suited for isolating the vibrations from the weights. Thus, the weights 16, 18 are not subject to the vibrations. As a result, the stability of the system composed of barbell weight and training arm is not disturbed. At the same time, the energy consumption of the motor 20 is kept low.

The first ring can also be formed as a leaf spring 26 that is wavey and has a ring-shape which surrounds the barbell bar 12. The spring 26 is mounted at the end of the barbell bar 12, and the fixed ring 16 is mounted on the spring 26, whereby the spring 26 isolates the weights 16, 18 from vibrations of the barbell bar 12.

The invention is not limited by the embodiments described above which are presented as examples only but can be modified in various ways within the scope of protection defined by the appended patent claims.

I claim:

1. A vibrating barbell, comprising:

a plastic, substantially tubular-shaped barbell bar;

means for vibrating said barbell bar, said vibrating means being mounted exclusively within said barbell bar and being operative to vibrate the barbell bar so that the barbell bar has a vibration amplitude of 1.2 to 0.6 mm at a frequency of 25 to 60 Hz;

weights attached to each end of said barbell; and a cushioning material interposed between the ends of said barbell and said weights and having a spring rate so as to isolate said weights from vibration of said barbell, the cushioning material being a wavy leaf-spring having a ring-shape which surrounds said barbell bar.

2. The vibrating barbell of claim 1, wherein the leaf spring is made of spring steel.

3. The barbell of claim 1, wherein said vibrating means comprises a motor mounted in a region of center of gravity within said barbell bar so as to avoid rotating free mass moments, the motor having an imbalance due to at least one of an unbalanced rotor and a balanced rotor having unbalanced masses connected to each end of the rotor.

4. The barbell of claim 1, wherein said weight comprises a fixed steel ring.

5. The barbell of claim 4, further comprising additional weights concentrically and removably mountable around the fixed rings.

6. The barbell of claim 5, wherein the unbalanced masses on each end of said rotor are equal in weight and symmetric to the center of gravity of the barbell bar and in phase with one another.

7. The barbell of claim 6, additionally comprising means for supplying the motor with electrical power from an outside electrical power supply line.

8. The barbell of claim 6, additionally comprising means for supplying the motor with electrical power from a battery arrangement housed within the fixed rings.

* * * * *